US005097999A

United States Patent [19]

Milano, Jr.

[11] Patent Number: 5,097,999

[45] Date of Patent: Mar. 24, 1992

[54] FORM FEEDING TRACTOR UTILIZING A COMPOSITE BELT WITH METAL PULL PINS

[75] Inventor: Arthur J. J. Milano, Jr., Burlington, Conn.

[73] Assignee: Seitz Corporation, Torrington, Conn.

[21] Appl. No.: 367,384

[22] Filed: Dec. 11, 1989

[51] Int. Cl.[5] ..... B65H 20/20

[52] U.S. Cl. ..... 226/74; 400/616.1; 226/87

[58] Field of Search ..... 226/74, 75, 87, 6; 400/616.1-616.3; 474/153, 154, 184; 198/834

[56] References Cited

U.S. PATENT DOCUMENTS

| | | | |
|---|---|---|---|
| 2,140,028 | 5/1936 | Nichols | 197/133 |
| 3,392,893 | 7/1968 | Bennett et al. | 226/74 |
| 3,477,626 | 10/1967 | Hilpert | 226/9 |
| 3,608,801 | 9/1971 | Nystrand | 226/74 |
| 3,688,959 | 9/1972 | Staneck et al. | 226/75 |
| 3,825,162 | 7/1974 | Hubbard | 226/74 |
| 4,130,230 | 12/1978 | Seitz | 226/74 |
| 4,159,794 | 7/1979 | Seitz | 226/75 |

FOREIGN PATENT DOCUMENTS

| | | |
|---|---|---|
| 1229552 | 12/1966 | Fed. Rep. of Germany . |
| 1436715 | 6/1973 | Fed. Rep. of Germany . |
| 649199 | 1/1951 | United Kingdom . |

OTHER PUBLICATIONS

C. M. McCray, *IBM Technical Disclosure Bulletin*, "Forms Feed Tractor", vol. 20, No. 11A, Apr. 1978.

*Primary Examiner*—Daniel P. Stodola
*Assistant Examiner*—P. Bowen

[57] ABSTRACT

The drive assembly for a form feeding tractor has a flexible endless belt comprising an endless band member of synthetic resin with a generrally planar outer surface and metallic drive pins spaced about its circumference. The band member has a series of spaced apart drive sections each with a plurality of drive teeth extending transversely thereof on its inner surface, and the metallic drive pins are disposed in the spaces between the drive sections. The pins have a base section which extends through the band member with a circumferential groove intermediate its length and into which the band member extends, and the band member has platform portions on its inner surface which extend about the base portions on the pins. The cooperating drive sprocket has in its circumference a series of spaced apart drive sections with transversely extending drive grooves configured and dimensioned to mesh with the drive teeth of the belt, and transversely extending recesses in its circumference in the spaces between the drive sections. The platform portions of the belt are received in the recesses which are of greater width than the platform portions to preclude engagement with the side faces of the platform portions.

10 Claims, 2 Drawing Sheets

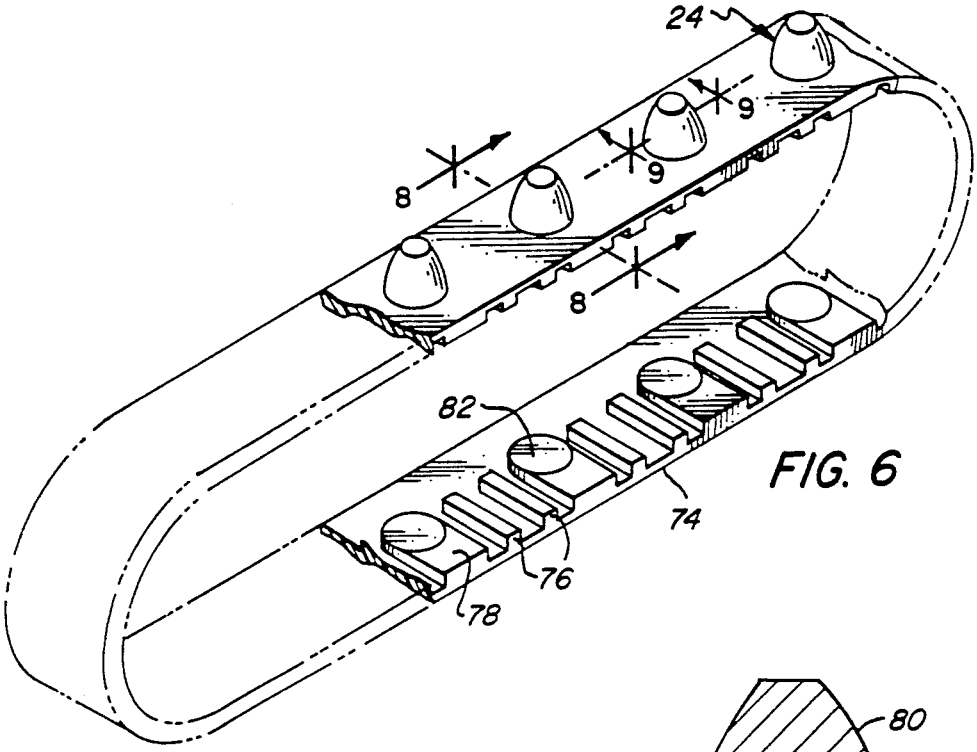
FIG. 6
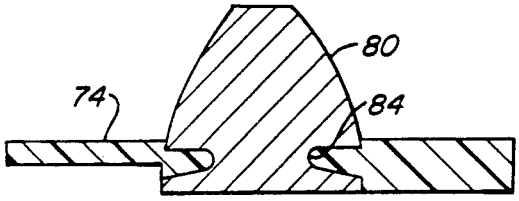
FIG. 8
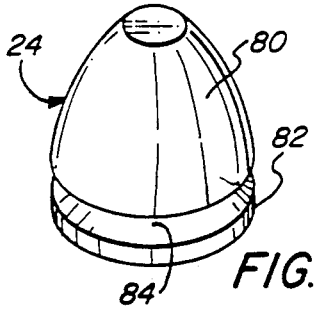
FIG. 7
FIG. 9
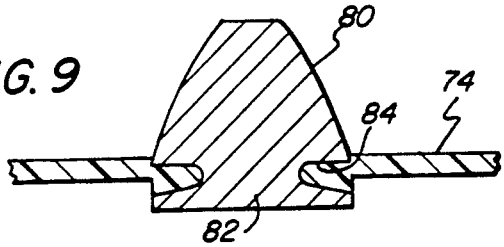
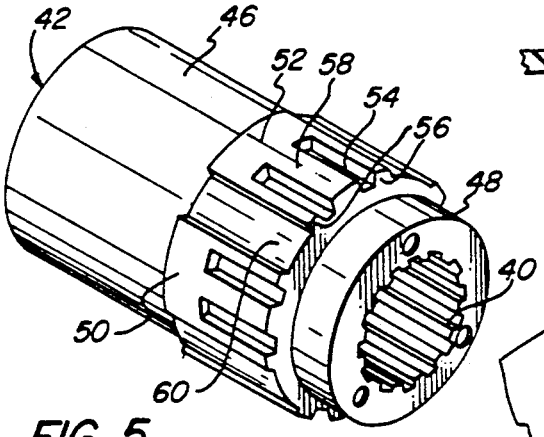
FIG. 5
FIG. 10
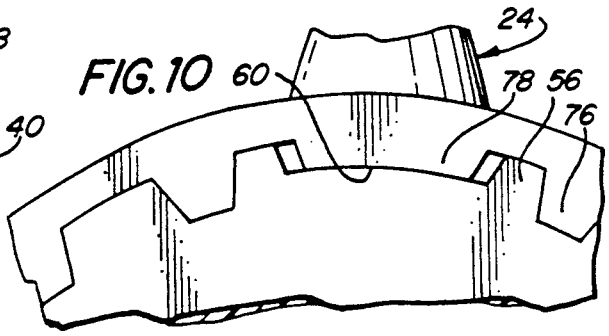

FORM FEEDING TRACTOR UTILIZING A COMPOSITE BELT WITH METAL PULL PINS

BACKGROUND OF THE INVENTION

The present invention relates to form feeding tractors and more particularly, to drive assemblies for tractors which are intended for high speed incremental advance of the form through the tractor.

In the past two decades, there has been rapidly increasing usage of form feeding tractors in printers and other devices which utilize webs such as continuous paper, individual paper sheets, tape and the like. In many instances, the webs have perforations along the side thereof in which drive pins of the tractor engage so as to advance the web therethrough. These webs are typically fabricated of paper, although foil, laminates and other sheet materials are also utilized, all collectively referred to hereinafter as "web material".

Generally, the tractors which are most widely employed have a continuous flexible synthetic resin belt with pins on its upper surface extending into the perforations of the web material, and drive teeth or cleats on the inner surface of the belt engage with cooperatively configured grooves or teeth on the sprockets of the tractor, one of which is driven to effect rotation of the belt.

In recent years belts molded from synthetic resin have been most widely employed. In most instances, the drive pins have been integrally molded with the continuous flat portion of the belt. Illustrative of such belt and sprocket assemblies is Seitz U.S. Pat. No. 4,130,230; in this structure the configuration of the belt and sprockets locates the drive pins in areas between the drive teeth which engage with the underlying sprocket. Thus, the belt and sprocket will mesh only in predetermined relative positions of the drive pins relative to the rotational position of the drive sprocket.

Composite belt constructions have also been proposed in order to facilitate fabrication of the belt or to provide greater wear resistance to the drive pins which are abraded by the web material as it moves downwardly and upwardly thereover. One such composite belt construction is shown in Hubbard U.S. Pat. No. 3,825,162 granted July 23, 1974.

More recently, the emphasis on high speed printers which start and stop at extremely rapid speeds as they advance in relatively short increments have produced conditions which increase the tendency for the web material to erode the surface of the drive pins. Thus, there has been a need to fabricate the pins from a more durable material than the flexible resins which are utilized for the continuous flexible belt.

Accordingly, it is an object of the present invention to provide a novel drive assembly for form feeding tractors in which the belt utilizes metal drive pins which are firmly secured in a relatively flexible strap.

It is also an object to provide such a drive assembly which can be fabricated relatively easily from synthetic resin and metal components, each providing its desirable characteristics to the composite structure.

Another object is to provide such a drive assembly in which the belt will flex readily in the area to either side of the drive pins as it moves about the drive sprockets.

SUMMARY OF THE INVENTION

It has now been found that the foregoing and related objects may be readily attained in In a form feeding tractor which has a drive assembly comprising a flexible endless belt formed from an endless band member of synthetic resin with a generally planar outer surface and metallic drive pins spaced about the circumference thereof. The band member has a series of spaced apart drive sections each with a plurality of drive teeth extending transversely thereof on its inner surface, and the metallic drive pins are disposed in the spaces between the drive sections.

The drive pins have a generally truncated conical section projecting outwardly of the outer surface of the band member and are adapted to seat in the perforations of a flexible web being transported on the tractor. The pins also have a base section extending through the band member with a circumferential groove intermediate its length and into which the material of the band member extends. The band member also has platform portions on its inner surface extending about the base portions of the pins.

The belt is drivingly engaged with a drive sprocket which has about its circumference a series of spaced apart drive sections each comprising a plurality of transversely extending drive grooves configured and dimensioned to mesh with the drive teeth of the belt. The sprocket also has transversely extending recesses in its circumference in the spaces between the drive sections, and the platform portions of the belt are received in these recesses which are of greater width than the platform portions to preclude engagement of the side faces of the platform portions.

Preferably, the recesses extend between the leading and trailing faces of adjacent drive sections of the drive sections, and the recesses are of lesser depth than the depth of the grooves in the drive sections.

The platform portions have leading and trailing faces which are inclined towards each other from the band member inner surface, and the adjacent leading and trailing faces of the drive sections are oppositely inclined towards their outer faces. The platform portions and recesses are dimensioned to support the inner face of the platform portions on the bottom surface of the recesses and to allow the band member to flex freely about the platform portions and pins as the belt with the platform portions disposed in the recesses follows a curved path at the ends of the tractor. There is at least 0.003 inch clearance between the adjacent faces of the platform portions and of the drive sections of the sprocket.

Desirably, the groove in the drive pin has a generally horizontal upper face and an upwardly inwardly inclined lower face.

BRIEF DESCRIPTION OF THE DRAWINGS

FIG. 5 is a perspective view of the drive sprocket;

FIG. 6 is a perspective view of the belt;

FIG. 7 is a perspective view of the drive pin utilized in the belt;

FIG. 8 is a sectional view along the line 8—8 of FIG. 6; and

FIG. 9 is a sectional view along the line 9—9 of FIG. 6; and

FIG. 10 is a elevational view to an enlarged scale of the belt and sprocket adjacent one of the drive pins.

DETAILED DESCRIPTION OF PREFERRED EMBODIMENT OF THE INVENTION

Figure 1:
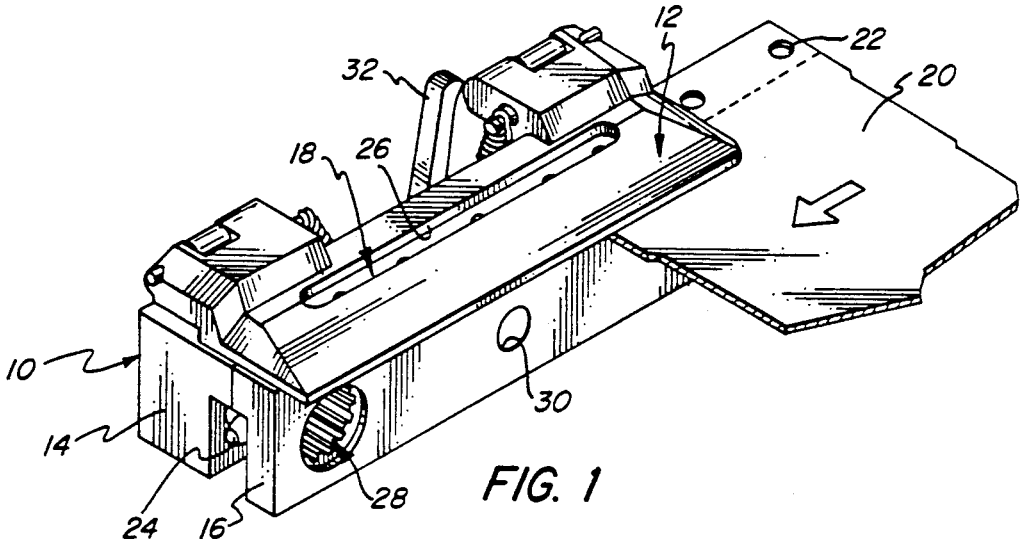
FIG. 1 is a perspective view of a form feeding tractor embodying the present invention with a fragmentary portion of a continuous perforated web shown as being transported therethrough.

Turning first to FIG. 1, therein illustrated is a form feeding tractor embodying the present invention with a chassis generally designated by the numeral 10 and a hinged cover generally designated by the numeral 12. As is conventional, the chassis 10 is comprised of a pair of sections 14, 16 which are locked together and provide a channel in which there is rotatably supported the endless belt generally designated by the numeral 18. Fragmentarily illustrated is a typical paper web or form 20 having perforations 22 along its side margins in which seat the drive pins 24 of the belt 18 to advance the paper web 20 as it rotates about the tractor. The cover 12 holds the paper web 20 on the pins 24 as it travels along a linear path through the tractor, and the cover 12 has a linear slot 26 into which the pins 24 extend during travel of the belt 18 along the linear path.

Adjacent the left end of the tractor as seen in FIG. 1 is a drive sprocket generally designated by the numeral 28 which is rotatably seated in an aperture in the chassis 10 and about which the belt 18 extends. At a point spaced from the drive sprocket 28, the chassis 10 has an aperture 30 extending therethrough, and a clamping or locking mechanism 32 (only the lever arm of which can be seen) is pivotably supported on the chassis 10 thereabout. In the typical paper feed tractor assembly, the tractor is mounted upon a pair of spaced parallel extending bars (not shown), a rotatable drive bar extending through the drive sprocket 28 and a fixed support bar extending through the clamping mechanism 32 and aperture 30.

Figure 2:
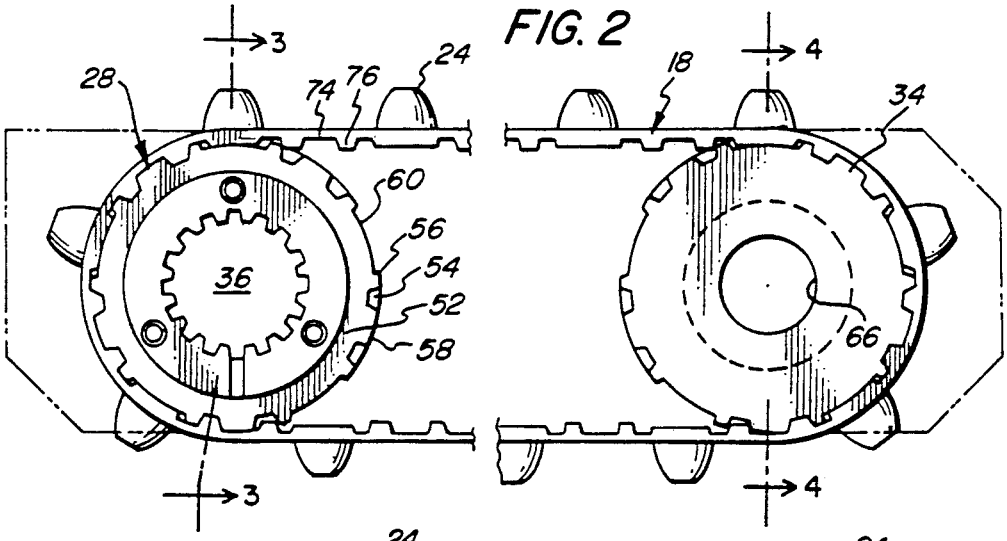
FIG. 2 is a fragmentary side elevational view of the tractor sprockets and belt with the outline of the tractor chassis shown in phantom line.

As seen in FIG. 2, the opposite end of the chassis 10 has rotatably mounted therein an idler sprocket generally designated by the numeral 34 and about which the belt 18 also extends.

Figure 3:
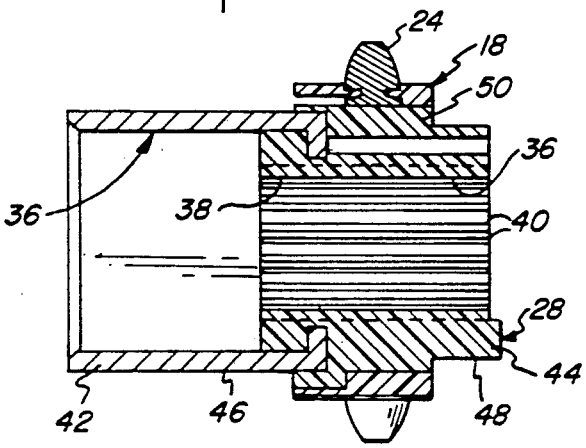
FIG. 3 is a sectional view along the line 3—3 of FIG. 2.

As seen in FIGS. 2 and 3, the drive sprocket 28 has an aperture or bore 36 extending therethrough with a reduced diameter portion 38 having teeth or splines 40 thereabout to firmly interengage with the drive shaft (not shown).

As seen in FIG. 3, the sprocket 28 is a composite of a metallic, generally cylindrical bearing element 42 and a synthetic resin element 44 which is molded thereonto. There is a larger diameter hub portion 46 provided by the bearing element 42 at one axial end and a smaller diameter hub portion 48 at the other end with a still larger diameter collar portion 50 therebetween. The collar portion 50 has circumferentially spaced drive sections 52 each with a pair of axially extending grooves 54 adjacent the hub portion 48 providing a pair of ribs 56 with a wider rib 58 therebetween. Between the drive sections 52 are recesses 60 of lesser depth than the base of the grooves 54. As will be seen in FIG. 2, the leading and trailing faces of the ribs 56 are inclined inwardly from their base.

Figure 4:
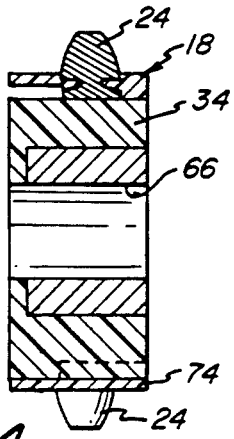
FIG. 4 is a sectional view along the line 4—4 of FIG. 2.

As seen in FIGS. 2 and 4, the idler sprocket 34 is comprised of a cylindrical bearing insert 62 and a synthetic resin body member 64, and it has a bore 66 extending therethrough. Its circumference is configured similarly to the collar portion 50 of the drive sprocket 28 with circumferentially spaced drive sections 68 corresponding to the drive sections 52 and recesses 70 therebetween.

Turning now to FIGS. 2 and 6–9, the belt 18 is illustrated in detail as including a relatively thin strap portion 74 and drive pins 24 which project outwardly therefrom. Extending transversely from one edge of the strap portion 74 and its inner surface are circumferentially spaced sets of drive teeth or cleats 76 and platform portions 78 spaced therebetween which are aligned with the pins 24. These formations are of substantially equal height, and the trailing and leading faces of the formations taper inwardly from their bases.

The drive pins 24 have an outwardly projecting portion 80 of generally frustoconical configuration and a base portion 82 extending through the strap portion 74 with a circumferential groove 84 thereabout. As best seen in FIGS. 8 and 9, the groove 84 has a generally horizontal upper surface and an inwardly and upwardly inclined lower surface. The resin of the platform portion 78 extends into the groove 84, and the platform portion 78 extends about more than half the periphery of the pin 24.

As previously indicated, there should be clearance between the adjacent surfaces of the drive sections of the sprocket and the platform portions sufficient to provide a short length of the thin strap to either side of the platform portions. This will permit flexing of the belt to curve on either side of the pins as the belt rotates about a curved path at either end of the tractor. Clearances between the adjacent faces of the platform portion and drive sections may vary from as little as 0.003 inch to 0.015 inch; however, the clearances are desirably in the order of 0.005–0.010 inch.

Various resins providing the desired flexibility and wear resistance may be utilized to produce the band member of the belt. Elastomeric polyesters have proven particularly advantageous in terms of providing a desirable balance of properties. The thickness of the strap portion in its narrowest sections should be within the range of 0.10–0.025 inch and preferably 0.015–0.020 inch.

Although various metals and alloys may be employed for the drive pins, stainless steel has proven particularly beneficial because of its resistance to wear and desirable appearance, and its retention of its properties during molding of the band member thereabout. As is apparent, the band member is folded about the pins which are supported within the mold.

In the illustrated embodiment, the teeth and platform portion extoned partially across the width of the belt, and the same is true with respect to the grooves in the drive section of the drive sprocket. In most tractor configurations, it is generally desirable to have the grooves, teeth and platform portions extend across the full width of the belt and the associated drive sprockets so as to provide optimum engagement between the drive surfaces and optimum support for the platform portions.

Various types of clamping mechanisms may be employed for gripping the fixed shaft of the tractor assembly including that shown in Seitz U.S. Pat. No. 4,819,849 granted Apr. 11, 1989 and that shown in Milano U.S. Pat. No. 4,471,896 granted Sept. 18, 1984. If so desired, the drive sprocket may incorporate means for accommodating aberrations in spacing between the drive and support shafts which may occur as a result of minor misalignment or bending of the shafts. Suitable compensating sprocket configurations are shown in Seitz et al U.S. Pat. No. 4,566,618 and Seitz U.S. Pat. No. 4,469,262. If so desired, the tractor may also include means for tensioning the belt such as that shown in Wald U.S. Pat. No. 4,638,935 granted Jan. 27, 1987 and Milano U.S. Pat. No. 4,805,822 granted Feb. 21, 1989.

Although it is possible to eliminate the idler sprocket and rely upon a fixed surface at the end of the tractor opposite the drive sprocket upon which the belt will slide, high speed tractors of the type to which the present invention is particularly applicable preferably employ an idler sprocket which moves freely and rapidly within the tractor to minimize wear upon both belt and tractor surfaces.

Thus, it can be seen from the foregoing detailed specification and attached drawings that the tractors employing the novel drive assembly of the present invention obtain the advantage of metal drive pins for increased life while at the same time enjoying the advantages of a flexible and durable strap. The elements of the drive assembly may be fabricated relatively easily from synthetic resin and metal components with each providing its desirable characteristics to the composite structure. The belt will flex readily in the area to either side of the drive pins as it moves about the drive sprocket so as to move efficiently with minimum wear and tear upon the material of the strap itself.

Having thus described the invention, what is claimed is:

1. In a tractor for feeding through a printer, flexible forms of the type having feeding apertures along the side edges thereof, the drive assembly comprising:

(a) a flexible endless belt comprising an endless band member of synthetic resin with a generally planar outer surface and metallic drive pins spaced about the circumference thereof, said band member having a series of spaced apart drive sections each with a plurality of drive teeth extending transversely thereof on its inner surface, said metallic drive pins being disposed in the spaces between said drive sections, said pins having a generally truncated conical section projecting outwardly of the outer surface of said band member and adapted to seat in the feeding apertures of an associated flexible form being transported on the tractor, said pins also having a base section extending through said band member with a circumferential groove intermediate its length and into which said band member extends, said band member having platform portions on its inner surface extending about said base portions of said pins and spaced from said drive sections, said platform portions having transversely extending side faces, end surfaces and a base surface; and (b) a drive sprocket having in its circumference a series of spaced apart drive sections each comprising a plurality of transversely extending drive grooves configured and dimensioned to mesh with the drive teeth of said belt, said sprocket also having transversely extending recesses in its circumference in the spaces between said drive sections, said platform portions of said belt being received in said recesses which are of greater width than said platform portions, said recesses having a base surface and side surfaces extending axially of the sprocket, said side surfaces of said recesses being spaced from said side faces of said platform portions to preclude engagement with the side faces of said platform portions, said recesses being of lesser depth than said grooves in said drive sections.

2. The tractor drive assembly in accordance with claim 1 wherein said recesses extend between the leading and trailing faces of adjacent drive sections of said drive sections which corresponds to said side surfaces of said recesses.

3. The tractor drive assembly in accordance with claim 1 wherein said platform portion side faces are inclined towards each other from said band member inner surface and the adjacent leading and trailing faces of said drive sections are oppositely inclined from their base.

4. The tractor drive assembly in accordance with claim 1 wherein said platform portions and recesses are cooperatively dimensioned to support the inner face of said platform portions on the bottom surface of said recesses and to allow said band member to flex freely about said platform portions and pins as said belt with said platform portions disposed in said recesses follows a curved path at the ends of the tractor.

5. The tractor drive assembly in accordance with claim 4 wherein there is at least 0.003 inch clearance between the adjacent side faces of said platform portions and said side surfaces of said drive sections of said sprocket defining said recesses.

6. The tractor drive assembly in accordance with claim 1 wherein said groove in said drive pin has a generally horizontal upper surface and an upwardly inwardly inclined lower surface.

7. In a tractor for feeding through a printer, flexible forms of the type having feeding apertures along the side edges thereof, the drive assembly comprising:

(a) a flexible endless belt comprising an endless band member of synthetic resin with a generally planar outer surface and metallic drive pins spaced about the circumference thereof, said band member having a series of spaced apart drive sections each with a plurality of drive teeth extending transversely thereof on its inner surface, said metallic drive pins being disposed in the spaces between said drive sections, said pins having a generally truncated conical section projecting outwardly of the outer surface of said band member and adapted to seat in the feeding apertures an associated flexible form being transported on the tractor, said pins also having a base section extending through said band member with a circumferential groove intermediate its length and into which said band member extends, said band member having platform portions on its inner surface extending about said base portions of said pins and spaced from said drive sections, said platform portions have transversely extending leading and trailing side faces which are inclined towards each other from said band member inner surface and the adjacent leading and trailing faces of said drive sections are oppositely inclined from their base, said platform portions also having end faces and a base surface; and (b) a drive sprocket having in its circumference a series of spaced apart drive sections each comprising a plurality of transversely extending drive grooves configures and dimensioned to mesh with the drive teeth of said belt, said sprocket also having transversely extending recesses in its circumference in the spaces between said drive sections, said recesses having a base surface and side surfaces extending axially of the sprocket, said platform portions of said belt being received in said recesses which are of greater width than said platform portions, said side surfaces of said recesses being spaced from said side faces of said platform portions to preclude engagement with the side faces of said platform portions, said recesses being of lesser depth than said grooves in said drive sections, said platform portions seating on said base surface of said recesses, said platform portions and recesses being cooperatively dimensioned to support said base surface of said platform portions on the bottom surface of said recesses and to allow said band member to flex freely about said platform portions and pins as said belt with said platform portions disposed in said recesses follows a curved path at the ends of the tractor.

8. The tractor drive assembly in accordance with claim 7 wherein said recesses extend between the leading and trailing faces of adjacent drive sections of said drive sprocket which corresponds to said side surfaces of said recesses.

9. The tractor drive assembly in accordance with claim 7 wherein there is at least 0.003 inch clearance between the side faces of said platform portions and of the adjacent side surfaces of said drive sections of said sprocket defining said side surfaces of said recesses.

10. The tractor drive assembly in accordance with claim 7 wherein said groove in said drive pin has a generally horizontal upper surface and an upwardly inwardly inclined lower surface.

* * * * *